US009995459B2

(12) United States Patent
Sun et al.

(10) Patent No.: US 9,995,459 B2
(45) Date of Patent: Jun. 12, 2018

(54) LASER STIMULATED WHITE-LIGHT LIGHTING SYSTEM

(71) Applicant: NATIONAL CENTRAL UNIVERSITY, Taoyuan (TW)

(72) Inventors: Ching-Cherng Sun, Taoyuan (TW); Tsung-Hsun Yang, Taoyuan (TW)

(73) Assignee: National Central University, Taoyuan (TW)

( * ) Notice: Subject to any disclaimer, the term of this patent is extended or adjusted under 35 U.S.C. 154(b) by 0 days. days.

(21) Appl. No.: 15/153,897

(22) Filed: May 13, 2016

(65) Prior Publication Data

US 2017/0276322 A1 Sep. 28, 2017

(30) Foreign Application Priority Data

Mar. 24, 2016 (TW) ..... 105109214 A

(51) Int. Cl.

| | |
|---|---|
| ***F21V 9/00*** | (2018.01) |
| ***F21V 9/16*** | (2006.01) |
| ***F21V 29/74*** | (2015.01) |
| ***F21V 7/04*** | (2006.01) |
| ***F21V 29/76*** | (2015.01) |
| *F21Y 113/00* | (2016.01) |

(52) U.S. Cl.

CPC ..... *F21V 9/16* (2013.01); *F21V 7/04* (2013.01); *F21V 7/045* (2013.01); *F21V 9/30* (2018.02); *F21V 29/74* (2015.01); *F21V 29/76* (2015.01); *F21Y 2113/00* (2013.01)

(58) Field of Classification Search

CPC ..... H01L 33/502; F21K 9/64; F21K 9/62

USPC ..... 362/293

See application file for complete search history.

(56) References Cited

U.S. PATENT DOCUMENTS

| | | | | |
|---|---|---|---|---|
| 2008/0149166 | A1* | 6/2008 | Beeson | H01L 31/02322 136/248 |
| 2012/0113672 | A1* | 5/2012 | Dubrow | B82Y 20/00 362/602 |
| 2014/0022512 | A1* | 1/2014 | Li | F21V 9/00 362/235 |
| 2016/0238203 | A1* | 8/2016 | Lenef | H01S 5/183 |

* cited by examiner

*Primary Examiner* — William Carter

(74) *Attorney, Agent, or Firm* — Juan Carlos A. Marquez; Marquez IP Law Office PLLC

(57) ABSTRACT

The present invention discloses a laser stimulated white light lighting system, it includes a hemispherical reflector, a light-permeable board, a wavelength conversion layer, a reflective layer and plural heat-radiating structures, wherein the laser light emitted by a laser light source passes through a first light entrance hole of the hemispherical reflector and subsequently through the wavelength conversion layer to produce white light. With the implementation of the present invention, complex production process or equipment is not required thus reduce the system cost, the lighting system is capable of accurately outputting white light and promoting photon recycling effect to raise illumination efficiency. With the addition of a second light entrance hole, wavelength-division or angular division multiplexing can be carried out to raise the intensity of the output white light without increasing the etendue of the source light, thereby widening the range of application of the lighting system.

11 Claims, 6 Drawing Sheets

LASER STIMULATED WHITE-LIGHT LIGHTING SYSTEM

BACKGROUND OF THE INVENTION

1. Technical Field

The present invention relates to a lighting system and more particularly to a laser stimulated white-light lighting system which has a hemispherical reflector, which uses laser as its light source, and which is configured to output high-intensity white light accurately and efficiently.

2. Description of Related Art

Nowadays, the use of energy-saving light sources is rapidly increasing, in particular light-emitting diodes (LEDs), which feature lower power consumption and sufficient light intensity.

The majority of commercially available LEDs are white LEDs, typically those with phosphor powder to be excited by a blue LED die. However, as such dies are characterized by a relatively large etendue, there has been problem effectively enhancing the efficiency of reaction between their blue light and the phosphor powder to be excited thereby. In addition, a blue LED driven by a large current tends to produce a droop effect, which further lowers light emission efficiency.

Therefore, it has been an important issue in the LED industry or even the entire illumination-related industry to develop a simple and effective technique or lighting system which can overcome the low efficiency problem associated with blue LEDs and is innovative in structural design so as to make effective use of photons and increase the overall etendue, the objective being to better the life quality of humanity while meeting the requirements of environmental protection and energy saving.

BRIEF SUMMARY OF THE INVENTION

The present invention relates to a laser stimulated white-light lighting system which includes a hemispherical reflector, a light-permeable board, a wavelength conversion layer, a reflective layer, and a plurality of heat-radiating structures; and in which the laser light emitted by a laser light source passes through a first light entrance hole of the hemispherical reflector and subsequently through the wavelength conversion layer to produce white light. The lighting system of the present invention can be implemented at low cost because it does not require a complex manufacturing process or complicated manufacturing equipment. The lighting system can output white light accurately and, given the same light source has higher light output efficiency than its prior art counterparts due to an enhancement in the photon recycling effect. With the addition of a second light entrance hole, wavelength-division or angular division multiplexing can be carried out to raise the intensity of the output white light without increasing the etendue of the source light, thereby widening the range of application of the lighting system.

The present invention provides a laser stimulated white-light lighting system which includes: a hemispherical reflector with a reflective curved surface and an opening, the reflective curved surface having at least one first light entrance hole; a light-permeable board fixedly provided at the opening and having an excitation area; a wavelength conversion layer fixedly attached to the excitation area; a reflective layer formed on the surface of the inner side of the light-permeable board in a region outside the excitation area; and a plurality of heat-radiating structures fixedly provided on the surface of the outer side of the light-permeable board in a region outside the excitation area; and in which the laser light emitted by a laser light source propagates through the first light entrance hole and subsequently through the wavelength conversion layer to produce white light.

Implementation of the present invention at least involves the following inventive steps:

1. A low implementation cost is made possible by dispensing with a complex manufacturing process and complicated manufacturing equipment;
2. White light can be output accurately;
3. By enhancing the photon recycling effect, light output efficiency is increased in comparison with those of like systems, given the same light source; and
4. The addition of a second light entrance hole enables wavelength-division or angular division multiplexing so that, without increasing the etendue of the source light, the intensity of the output white light can be raised.

The features and advantages of the present invention are detailed hereinafter with reference to the preferred embodiments. The detailed description is intended to enable a person skilled in the art to gain insight into the technical contents disclosed herein and implement the present invention accordingly. In particular, a person skilled in the art can easily understand the objects and advantages of the present invention by referring to the disclosure of the specification, the claims, and the accompanying drawings.

BRIEF DESCRIPTION OF THE SEVERAL VIEWS OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
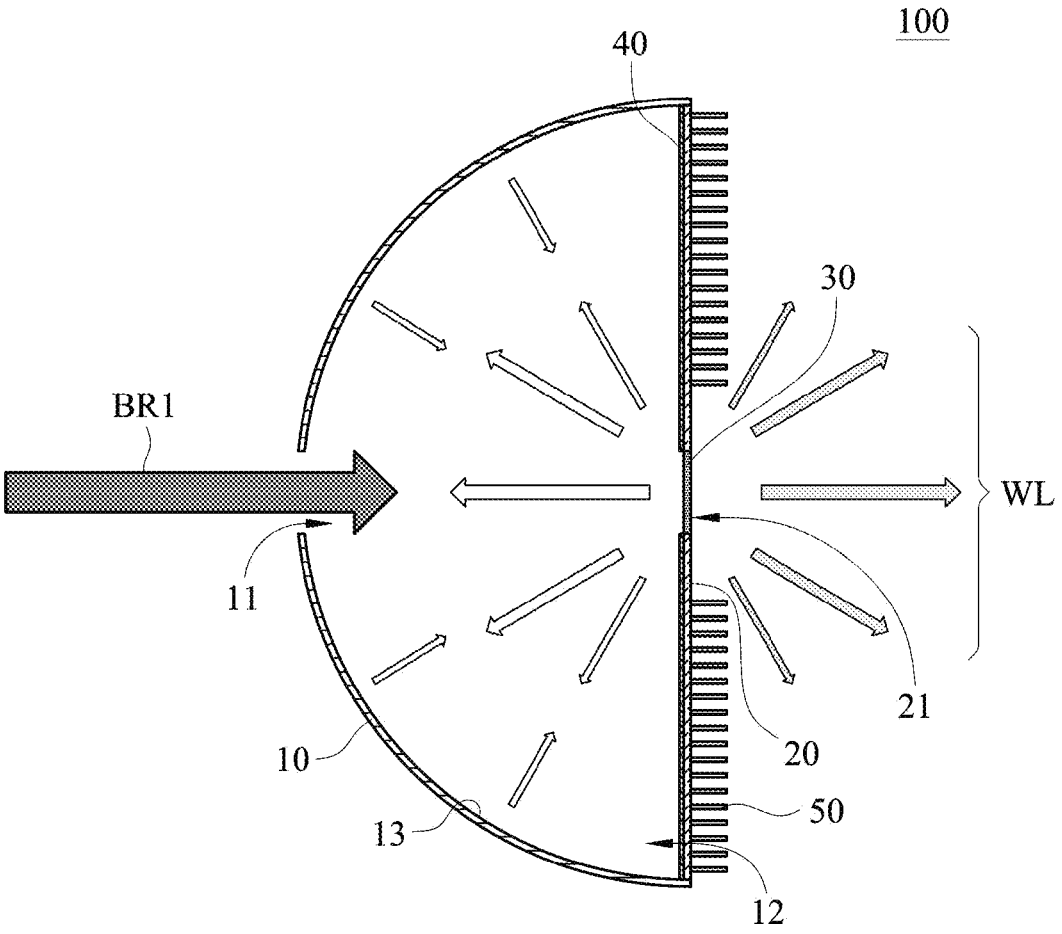
FIG. 1 is a schematic sectional view of the laser stimulated white-light lighting system in an embodiment of the present invention.
Figure 3:
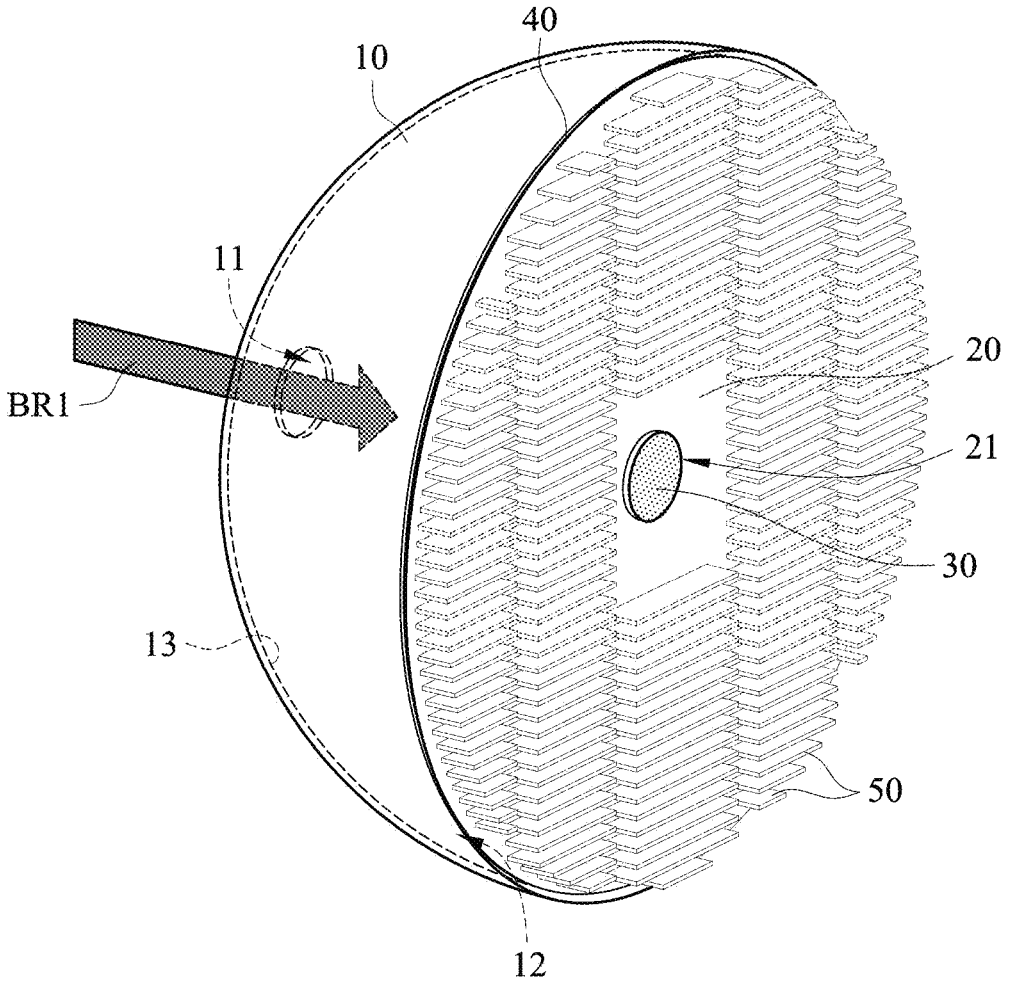
FIG. 3 is a schematic perspective view of the laser stimulated white-light lighting system in FIG. 1.

Referring to FIG. 1 and FIG. 3, the laser stimulated white-light lighting system 100 in an embodiment of the present invention includes a hemispherical reflector 10, a light-permeable board 20, a wavelength conversion layer 30, a reflective layer 40, and a plurality of heat-radiating structures 50.

As shown in FIG. 1 and FIG. 3, the hemispherical reflector 10 of the laser stimulated white-light lighting system 100 has a reflective curved surface 13 and an opening 12. The reflective curved surface 13 is provided with a first light entrance hole 11.

There are no special limitations on the material of the hemispherical reflector 10. For example, the hemispherical reflector 10 can be formed of ceramic, metal, or other heat-resistant substances. The hemispherical reflector 10 is so shaped that light reflected from the reflective layer 40, which is provided on the light-permeable board 20, can be reflected by the hemispherical reflector 10 to an excitation area 21, as described in more detail below.

Figure 2:
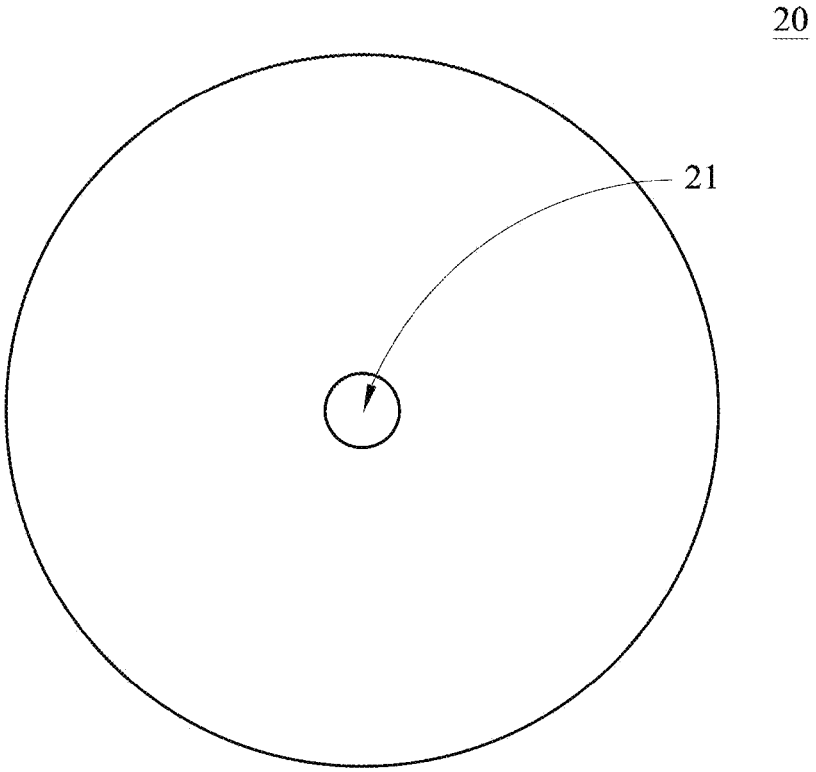
FIG. 2 is a schematic front view of the light-permeable board in the lighting system in FIG. 1.

As shown in FIG. 1, FIG. 2, and FIG. 3, the light-permeable board 20 is fixedly provided at the opening 12 and has the excitation area 21. The laser stimulated white-light lighting system 100 is configured to emit white light WL by projecting laser light BR1 from a light source through the first light entrance hole 11 into the hemispherical reflector 10 and by reflecting the laser light BR1 in such a way that the reflected light strikes the excitation area 21 and passes through the wavelength conversion layer 30 to produce the white light WL.

Referring to FIG. 1 and FIG. 3, the light-permeable board 20 is connected with the hemispherical reflector 10 to form a hemispherical reflective enclosure. The laser light BR1 entering the first light entrance hole 11 is reflected by the reflective layer 40 to the reflective curved surface 13 of the hemispherical reflector 10 and then reflected by the reflective curved surface 13 to the excitation area 21.

The light-permeable board 20 can be formed of glass, a sapphire substrate, transparent ceramic, monocrystalline aluminum, or polycrystalline aluminum.

With continued reference to FIG. 1 and FIG. 3, the wavelength conversion layer 30 is fixedly attached to the excitation area 21 of the light-permeable board 20. For instance, the wavelength conversion layer 30 is applied to the excitation area 21 of the light-permeable board 20 by spray coating.

The wavelength conversion layer 30 in FIG. 1 and FIG. 3 is intended to be illuminated by the laser light BR1 having entered the first light entrance hole 11 and generate the white light WL by a color mixing process. The white light WL will be projected out of the laser stimulated white-light lighting system 100 from the excitation area 21.

The laser light BR1 can be blue, with a wavelength ranging from 360 to 480 nm. The wavelength conversion layer 30 can be a layer of phosphor powder, of quantum dots layer, or of a photoluminescent material.

When the wavelength conversion layer 30 is a phosphor powder layer that can be formed of yellow phosphor powder, a mixture of red and green phosphor powder, or a mixture of orange and green phosphor powder, and also the phosphor powder layer can be formed as a phosphor powder film or a phosphor powder crystal. Further, the forming material of the phosphor powder layer can be yttrium aluminum garnet (YAG), silicate, or nitride.

Referring again to FIG. 1 and FIG. 3, the reflective layer 40 is formed or coated on the inner surface of the light-permeable board 20 (i.e., the surface opposite the reflective curved surface 13) in a region excluding the excitation area 21.

Figure 4:
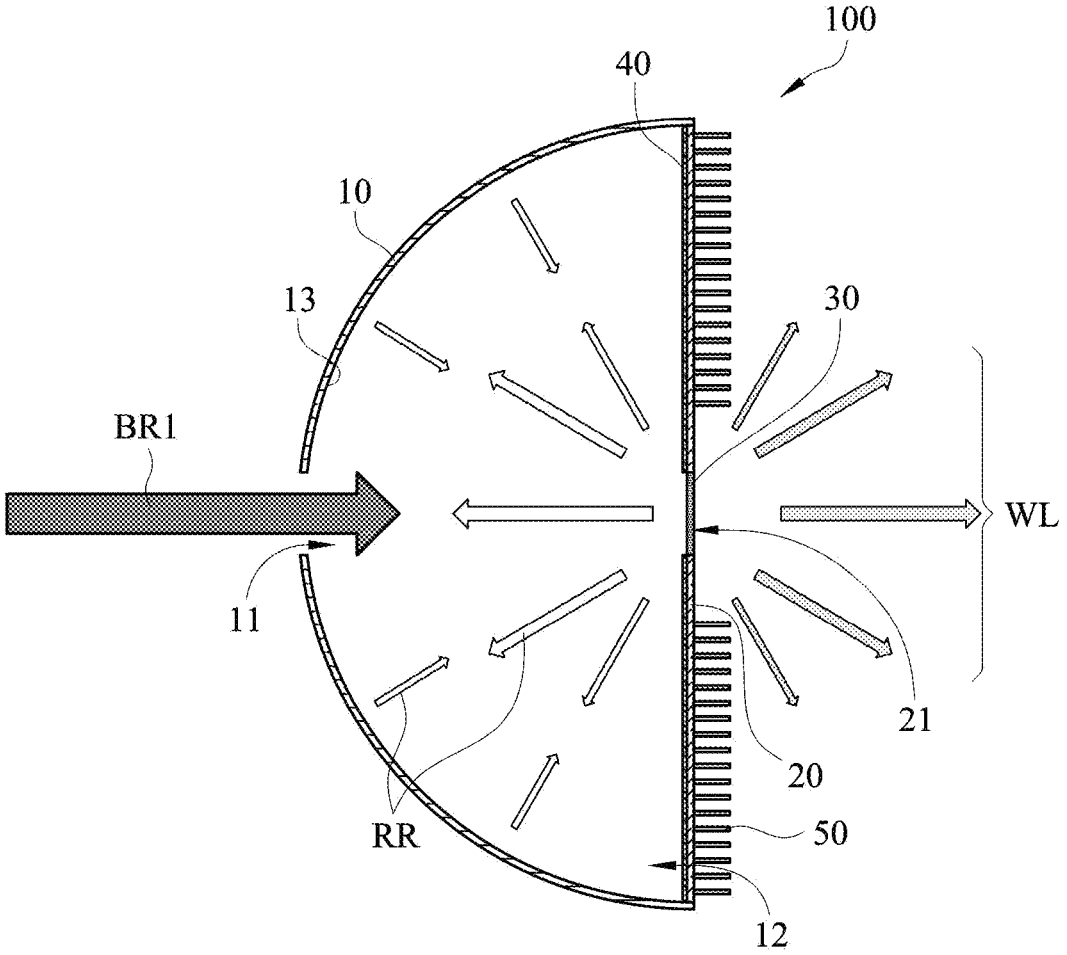
FIG. 4 schematically shows how light is reflected between the hemispherical reflector and the light-permeable board in the lighting system in FIG. 1.

As shown in FIG. 1, FIG. 3, and FIG. 4, the laser light BR1 incident on the aforesaid region excluding the excitation area 21 is reflected by the reflective layer 40 to the reflective curved surface 13 as reflected light RR. The reflective curved surface 13, in turn, reflects the reflected light RR to the excitation area 21 and the wavelength conversion layer 30 in order to produce the white light WL by a color mixing process.

To enhance heat dissipation from the laser stimulated white-light lighting system 100, referring to FIG. 1 and FIG. 3, the plural heat-radiating structures 50 are fixedly provided on the surface of the outer side of the light-permeable board 20 in a region excluding the excitation area 21.

At least one of the heat-radiating structures 50 can be an easily available heat-radiating fin which is effective in heat dissipation and has a relatively low cost of use.

Figure 5:
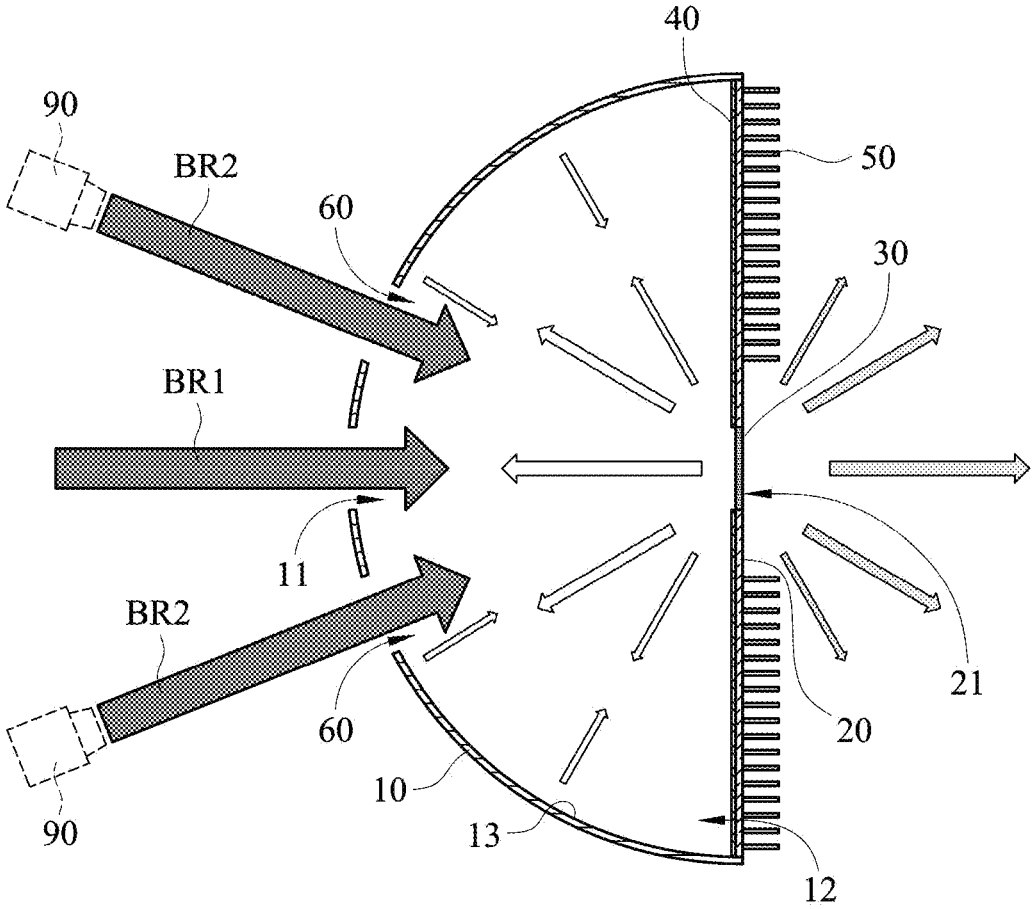
FIG. 5 is a schematic sectional view of the laser stimulated white-light lighting system in another embodiment of the present invention, wherein the lighting system is additionally provided with second light entrance holes.
Figure 6:
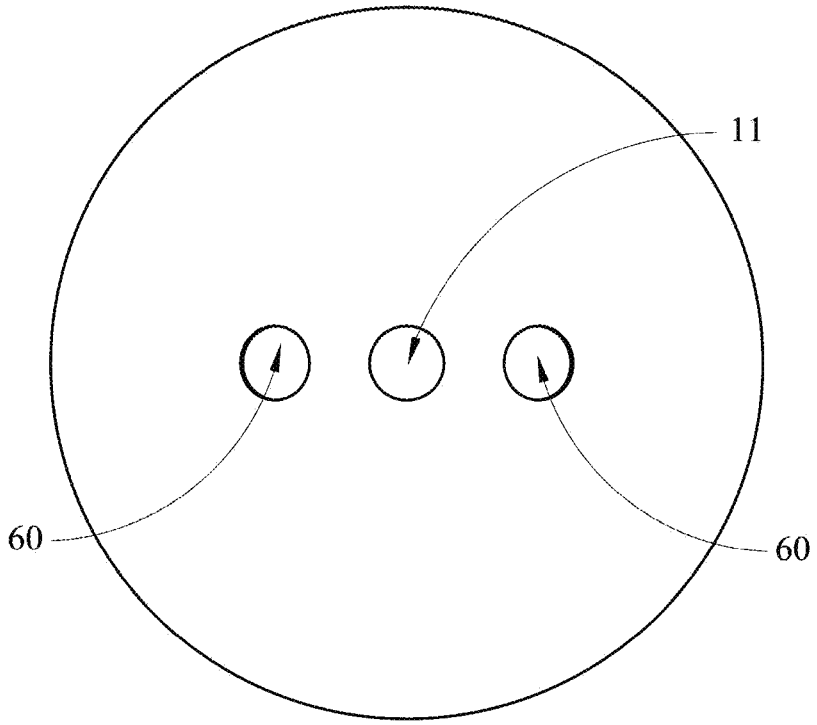
FIG. 6 is a schematic rear view of the hemispherical reflector in the lighting system in FIG. 5.

The hemispherical reflector 10 may be further formed with at least one second light entrance hole 60 as shown in FIG. 5 and FIG. 6.

Each of the at least one second light entrance hole 60 allows passage of light from a blue laser 90. More specifically, the blue light BR2 emitted by the blue lasers 90 propagates through the second light entrance holes 60 respectively, is incident on the wavelength conversion layer 30, and produces the white light WL by a color mixing process taking place in the wavelength conversion layer 30.

When the laser light BR1 and the blue light BR2 passing respectively through the first light entrance hole 11 and the second light entrance holes 60 reach the wavelength conversion layer 30 at the same time, wavelength-division multiplexing or angular division multiplexing is carried out. As a result, the output, or intensity, of the white light WL (which is produced by a color mixing process taking place in the wavelength conversion layer 30) is raised without increasing the etendue of the laser light BR1 or the blue light BR2. This allows the range of application of the laser stimulated white-light lighting system 100 to be expanded. Etendue is also referred to as the optical invariant and can be used to describe the geometric properties (e.g., the divergence angle or a cross-sectional area) of a light beam.

In a nutshell, the laser stimulated white-light lighting system 100 can output the white light WL accurately by illuminating the wavelength conversion layer 30 (which is coated on the light-permeable board 20, where the heat-radiating structures 50 are located) with only the laser light BR1 or both the laser light BR1 and the blue light BR2 while the hemispherical reflector 10 enhances the photon recycling effect of the laser light BR1 or the blue light BR2 to increase light output efficiency. Moreover, the additional second light entrance holes 60 enable wavelength-division or angular division multiplexing so that the intensity of the output white light WL can be raised without increasing the etendue of the laser light BR1 or the blue light BR2.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A laser stimulated white-light lighting system, comprising:

a hemispherical reflector having a reflective curved surface and an opening, wherein the reflective curved surface is provided with a first light entrance hole;

a light-permeable board fixedly provided at the opening and having an excitation area;

a wavelength conversion layer fixedly attached to the excitation area;

a reflective layer formed on a surface of an inner side of the light-permeable board in a region outside the excitation area; and a plurality of heat-radiating structures fixedly provided on a surface of an outer side of the light-permeable board in a region outside the excitation area;

wherein laser light emitted by a laser light source passes through the first light entrance hole and then through the wavelength conversion layer to produce white light, wherein the hemispherical reflector is further formed with at least one second light entrance hole and each said second light entrance hole allows passage of blue light from a blue laser to the wavelength conversion layer in order to produce white light, and when the laser light and the blue light passing respectively through the first light entrance hole and the second light entrance holes reaching the wavelength conversion layer at the same time, wavelength-division multiplexing or angular division multiplexing being carried out.

2. The white-light lighting system of claim 1, wherein the light-permeable board and the hemispherical reflector are connected together to form a hemispherical reflective enclosure.

3. The white-light lighting system of claim 1, wherein the light-permeable board is formed of glass, a sapphire substrate, transparent ceramic, monocrystalline aluminum, or polycrystalline aluminum.

4. The white-light lighting system of claim 1, wherein the laser light is blue, and the wavelength conversion layer is a phosphor powder layer, a quantum dot layer, or a layer formed of a photoluminescent material.

5. The white-light lighting system of claim 1, wherein the wavelength conversion layer is a phosphor powder layer formed of yellow phosphor powder, of a mixture of red and green phosphor powder, or of a mixture of orange and green phosphor powder.

6. The white-light lighting system of claim 5, wherein the phosphor powder layer is formed as a phosphor powder film or a phosphor powder crystal.

7. The white-light lighting system of claim 5, wherein the phosphor powder layer is formed of yttrium aluminum garnet (YAG), a silicate, or a nitride.

8. The white-light lighting system of claim 1, wherein the wavelength conversion layer is spray-coated on the excitation area.

9. The white-light lighting system of claim 1, wherein the laser light has a wavelength ranging from 360 to 480 nm.

10. The white-light lighting system of claim 1, wherein at least one of the heat-radiating structures is a heat-radiating fin.

11. The white-light lighting system of claim 1, wherein wavelength-division multiplexing at 430 nm and 460 nm or angular division multiplexing is carried out to raise intensity of the white light produced, without increasing etendue of the laser light or the blue light.

* * * * *